US009061781B2

(12) United States Patent
Palmer

(10) Patent No.: US 9,061,781 B2
(45) Date of Patent: Jun. 23, 2015

(54) PORTABLE TRASH BAG SUPPORT

(71) Applicant: BRAINCASE SOLUTIONS, LLC, San Diego, CA (US)

(72) Inventor: David Palmer, San Diego, CA (US)

(73) Assignee: BRAINCASE SOLUTIONS, LLC, Poway, CA (US)

( * ) Notice: Subject to any disclaimer, the term of this patent is extended or adjusted under 35 U.S.C. 154(b) by 93 days.

(21) Appl. No.: 13/692,563

(22) Filed: Dec. 3, 2012

(65) Prior Publication Data

US 2014/0150397 A1 Jun. 5, 2014

(51) Int. Cl.

| | |
|---|---|
| ***B66F 19/00*** | (2006.01) |
| ***B65B 67/12*** | (2006.01) |
| ***A47L 13/52*** | (2006.01) |
| ***B65F 1/14*** | (2006.01) |

(52) U.S. Cl.

CPC ..... *B65B 67/1238* (2013.01); *A47L 13/52* (2013.01); *Y10T 29/49826* (2015.01); *B65B 67/1222* (2013.01); *B65F 1/1415* (2013.01)

(58) Field of Classification Search

CPC A47L 13/52; B65B 67/1222; B65B 67/1238; Y10T 29/49826; B65F 1/1415

USPC ..... 294/1.4–1.5, 59, 176, 214; 220/495.06, 220/495.08, 495.11, 908, 908.1, 908.3; 248/99–101; 141/108–109, 338; 15/257.1

See application file for complete search history.

(56) References Cited

U.S. PATENT DOCUMENTS

| | | | | | |
|---|---|---|---|---|---|
| 637,248 | A | * | 11/1899 | Hagstrom | 248/101 |
| 926,927 | A | * | 7/1909 | Devol | 15/257.2 |
| 1,414,575 | A | * | 5/1922 | McCart | 248/97 |
| 4,787,753 | A | * | 11/1988 | Barnhart | 383/33 |
| D318,350 | S | * | 7/1991 | Muffuletto | D32/35 |
| 5,031,948 | A | | 7/1991 | Groth | |
| 6,052,860 | A | | 4/2000 | Coxsey | |
| 6,520,554 | B2 | * | 2/2003 | Ditzik | 294/214 |
| 7,703,723 | B1 | * | 4/2010 | Cooper et al. | 248/97 |
| 8,100,446 | B1 | | 1/2012 | Moore | |
| 8,267,358 | B1 | * | 9/2012 | Letson | 248/99 |
| 2006/0152023 | A1 | | 7/2006 | Owens | |
| 2010/0200709 | A1 | * | 8/2010 | Wilkinson | 248/99 |
| 2011/0037280 | A1 | | 2/2011 | Romero | |

* cited by examiner

*Primary Examiner* — Stephen Vu
(74) *Attorney, Agent, or Firm* — Nydegger & Associates

(57) ABSTRACT

A device for collecting objects is provided which includes a frame formed with a peripheral groove that surrounds an orifice. Also included is a retainer member that is dimensioned to be received into the peripheral groove of the frame. A bag having an opening which is surrounded by a rim portion is held with its rim in the peripheral groove of the frame, This is accomplished by a fixed engagement between the frame and the retainer member. With this engagement, objects can be introduced into the bag, through the orifice of the frame, for collection.

9 Claims, 2 Drawing Sheets

PORTABLE TRASH BAG SUPPORT

FIELD OF THE INVENTION

The present invention pertains generally to systems and methods that are useful for the collection and disposal of waste product(s). More particularly, the present invention pertains to devices which can be individually assembled, subsequently manipulated to collect waste products in a flexible bag, and then be disassembled for disposal of the bag with the waste products. The present invention is particularly, but not exclusively useful for rigidly engaging the rim of a flexible bag between the periphery of a frame and a retainer member to establish a structured opening through which objects (i.e. waste product) can be introduced into the bag for collection and disposal.

BACKGROUND OF THE INVENTION

Trash bags, also called trash can liners, are disposable plastic receptacles/bags that are designed to hold various waste items such as household trash, leaves, debris, grass cuttings and pet waste. These bags come in various sizes and are typically made of a thin walled polyethylene material.

In the yard, and around the home, it is often desirable to transfer a pile of waste material into a trash bag. Due to the flexible nature of the thin wall trash bags, it can often be a challenge to hold the bag open while simultaneously transferring material into the bag. This is especially true if the waste is on the ground and is not easily picked up and placed in the bag. Indeed, for several forms of waste material, there is a practical need to hold the bag at ground level so that the waste can be swept, scooped or raked into the bag. Although dust pans and other similar cleaning utensils may be effective in simplifying this operation for small waste piles, they are often unsuitable for use with larger waste piles.

In light of the above, it is an object of the present invention to provide a trash bag support that can be quickly attached to a common trash bag to hold the bag open and facilitate the transfer of waste into the trash bag. It is another object of the present invention to provide a trash bag support that can be attached to a common trash bag to allow large piles of waste material to be quickly swept, scooped or raked into the trash bag. It is yet another object of the present invention to provide a portable trash bag support that is easy to use, relatively simple to implement and comparatively cost effective.

SUMMARY OF THE INVENTION

For the present invention, a device for collecting objects is disclosed which includes a frame, a retainer member and a flexible bag. For the device, the frame is formed with a peripheral groove that surrounds an orifice. In addition, the frame can be characterized as having an irregular planar periphery, with the periphery being axisymmetric with respect to an axis in the plane of the periphery.

Structurally, the frame is formed with a ramp that extends along a portion of the frame's periphery and is oriented substantially perpendicular to the axis. More particularly, for the present invention, the ramp defines a straight edge with a flat surface that extends between the straight edge and the periphery. With this arrangement, the flat surface of the ramp is inclined at an angle "$\phi$" relative to the axis. For example, the incline angle "$\phi$" of the ramp is typically in a range that is between about three degrees and about ten degrees ($3° < \phi < 10°$).

Also for the present invention, the device includes a retainer member that is dimensioned to be received into the peripheral groove of the frame. For example, the frame and the retainer member can be made of a rigid plastic. An engagement mechanism can be provided to establish a fixed engagement between the frame and the retainer member. With this structural arrangement, a flexible bag having an opening which is surrounded by a rim portion can be held with its rim between the frame and the retainer member.

In more structural detail, the engagement mechanism can include a receiving unit that is formed at the periphery of the frame and an engagement unit that is formed on the retainer member. For example, the receiving unit can be located adjacent the frame's peripheral groove and can include an access aperture that is straddled by a pair of holes. In an exemplary embodiment, the holes extend through the frame and into the groove. To cooperate with the receiving unit, the engaging unit on the retainer member can include a press point that is straddled by a pair of retention tabs. During an engagement of the retainer member and the frame, the retention tabs of the engaging unit are received into the holes of the receiving unit and the press point is positioned in the access aperture. This allows the rim of the bag to be held between the frame and retainer member. With this engagement, objects can be introduced into the bag, through the orifice of the frame, for collection. To disengage the retainer member from the frame and remove the bag, finger pressure can be applied to the press point to dislodge the retention tabs from the holes.

In accordance with the present invention, the device can include a handle for holding the assembly during use. In one embodiment, the handle is formed on the frame at a location opposite the orifice from the ramp. Alternatively, or in addition to the handle formed on the frame, a receptacle for receiving an elongated pole can be provided on the frame. In some implementations, a bracket can be mounted on the pole to selectively hold an accessory. For example, the accessory may be a broom having an elongated extension and a substantially planar bristle brush. To match the frame, the bristle brush can be inclined to the extension at an angle "$\theta$", wherein the angle "$\theta$" is in a range between ten and thirty degrees ($10° < \theta < 30°$). Alternatively, the accessory can be a scoop having an elongated extension and a shovel portion. To match the frame, the shovel portion can be inclined to the extension at an angle "$\theta$", wherein the angle "$\theta$" is in a range between ten and thirty degrees ($10° < \theta < 30°$). In yet another alternative embodiment, the accessory may be a rake having an elongated extension and a substantially planar tine array. To match the frame, the tine array can be inclined to the extension at an angle "$\theta$", wherein the angle "$\theta$" is in a range between ten and thirty degrees ($10° < \theta < 30°$).

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
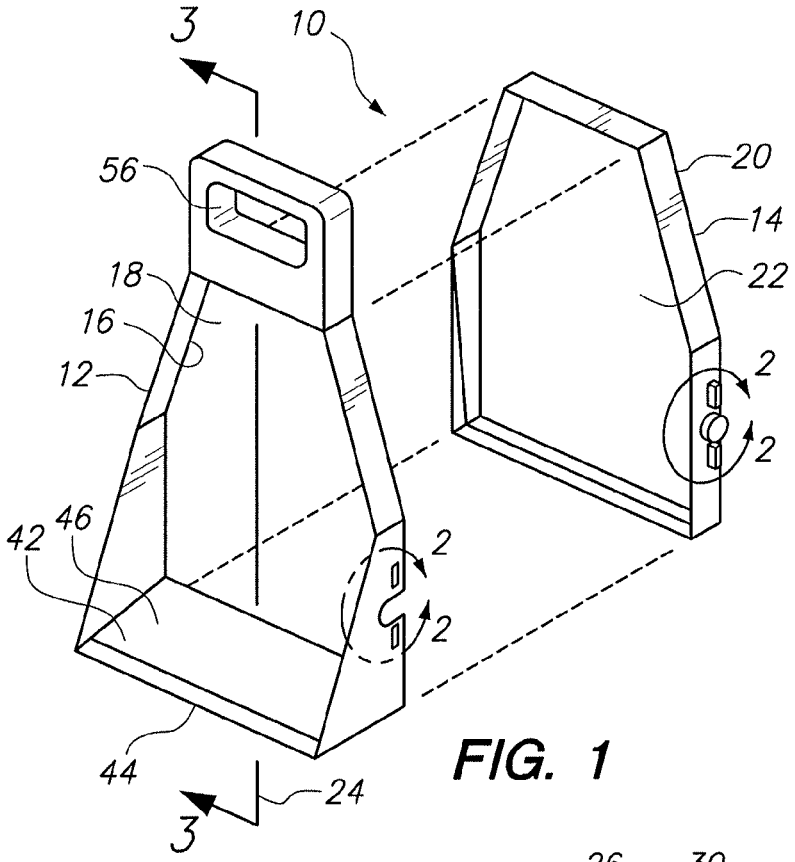
FIG. 1 is a an exploded perspective view of a frame and a retainer member in accordance with the present invention.

Referring initially to FIG. 1, a device for collecting objects is shown and is generally designated 10 (objects not shown). As shown, the device 10 includes a frame 12 and a retainer member 14 that are sized to fit together as explained in more detail below. For example, the frame 12 and the retainer member 14 can be made of a rigid, molded plastic. For the device 10, the frame 12 is formed with an irregular planar periphery 16 that surrounds an orifice 18, and the retainer member 14 is formed with a periphery 20 that surrounds an orifice 22 having a similar size and shape as orifice 18. In addition, as shown, the irregular planar periphery 16 is axisymmetric with respect to an axis 24 in the plane of the periphery 16.

Figure 2A:
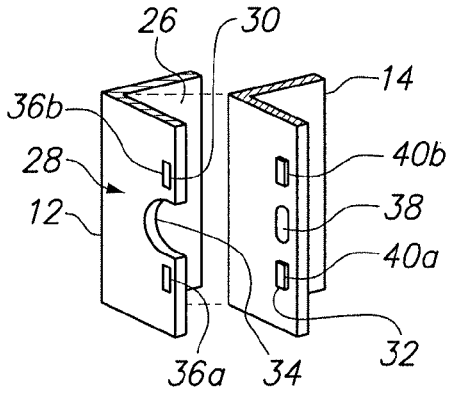
FIG. 2A is an exploded perspective view of portions of the frame and of the retainer member as respectively seen within the lines 2-2 in FIG. 1.
Figure 2B:
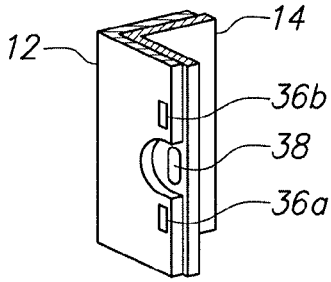
FIG. 2B is a perspective view of the respective portions of the frame and retainer member as seen in FIG. 2A when the retainer member has been engaged with the frame.

Continuing now with cross reference to FIGS. 1 and 2A, it can be seen that the frame 12 is formed with a peripheral groove 26 that extends around the periphery 16 of the frame 12. Moreover, as best seen cross referencing FIGS. 2A and 2B, the retainer member 14 is shaped and dimensioned to be received into the peripheral groove 26 of the frame 12. Also as shown, engagement mechanism 28 can be provided to establish a fixed engagement between the frame 12 and the retainer member 14. FIG. 2A shows that the engagement mechanism 28 can include a receiving unit 30 that is formed on the frame 12 and an engagement unit 32 that is formed on the retainer member 14. As shown, the receiving unit 30 can be located adjacent the frame's peripheral groove and includes an access aperture 34 that is straddled by a pair of holes 36*a,b* that extend through the frame 12 and into the groove 26. To cooperate with the receiving unit 30 of the frame, the engaging unit 32 on the retainer member 14 includes a press point 38 that is straddled by a pair of retention tabs 40*a,b*. During an engagement of the retainer member 14 and the frame 12, the retention tabs 40*a,b* cause a slight deformation of the walls of the retainer member 14 and/or frame 12 to allow the retention tabs 40*a,b* to pass into the holes 36*a,b* of the receiving unit 30. With the retention tabs 40*a,b* positioned in the holes 36*a,b*, FIG. 28 shows that the access aperture 34 is positioned to overlay and expose the press point 38. To disengage the retainer member 14 from the frame 12, finger pressure can be applied to the press point 38 to dislodge the retention tabs 40*a,b* from the holes 36*a,b*.

Figure 3:
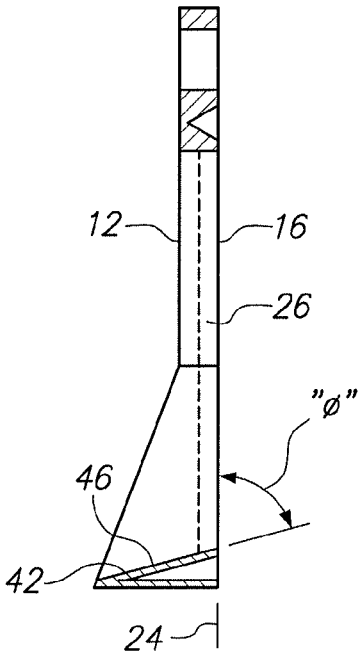
FIG. 3 is a cross section view of the frame as seen along the line 3-3 in FIG. 1.

Cross referencing FIGS. 1 and 3, it can be seen that the frame 12 includes a ramp 42 that extends along a portion of the periphery 16 and is oriented substantially perpendicular to the axis 24, Also shown, the ramp 42 defines a straight edge 44 with a flat surface 46 that extends between the straight edge 44 and the periphery 16. With this arrangement, as best seen in FIG. 3, the flat surface 46 of the ramp 42 is inclined at an angle "ϕ" relative to the axis 24. For example, the incline angle "ϕ" of the ramp 42 is typically in a range that is between about three degrees and about ten degrees ($3° < \phi < 10°$).

Figure 4:
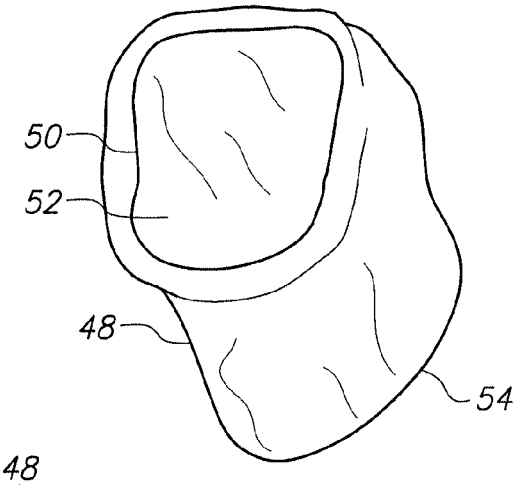
FIG. 4 is a perspective view of a flexible bag as used for the present invention.

FIG. 4 shows a flexible bag 48 for use with the frame 12 and retainer member 14 shown in FIG. 1. As shown in FIG. 4, the flexible bag 48 includes a rim 50 that surrounds a bag opening 52. As envisioned for the present invention, the bag 46 is preferably made of a plastic material. The bag 48, however, may be made of net-mesh material, burlap or canvas, Further, bag 48 may be made of any non-plastic material well known in the art, and can be used for a variety of uses, such as the disposal of hospital waste or hazardous materials. Succinctly stated, the manufacture of bag 48 is basically dependent on the requirements of its intended use.

Figure 5:
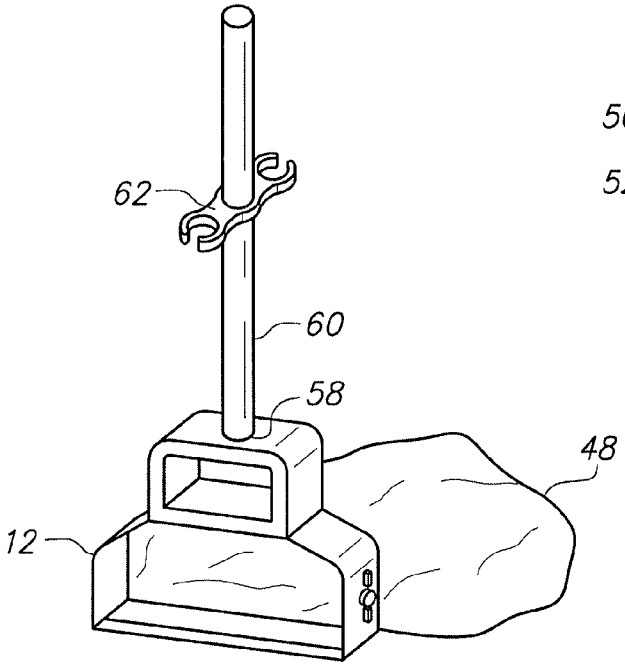
FIG. 5 is a perspective view of an alternate embodiment of the device of the present invention with the retainer member engaged with the frame to hold a flexible hag therebetween.
Figure 6A:
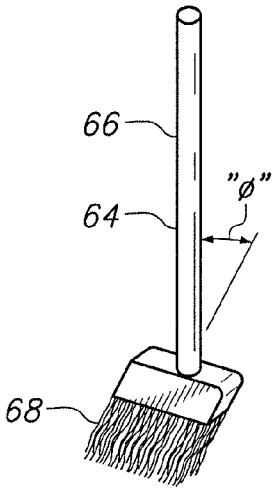
FIG. 6A is a perspective view of a broom for use with the device of the present invention.
Figure 6B:
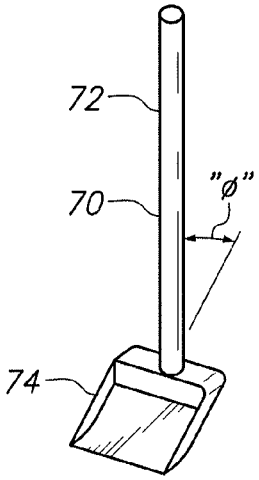
FIG. 6B is a perspective view of a scoop for use with the device of the present invention.
Figure 6C:
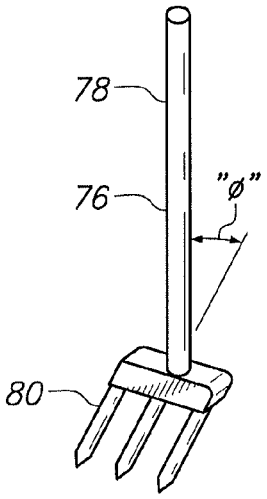
FIG. 6C is a perspective view of a rake for use with the device of the present invention.

To assemble and use the device 10 (FIG. 1) with the bag 48 (FIG. 4), the rim 50 of the bag 48 is first positioned between the groove 26 of the frame 12 and the retainer member 14. For example, the closed end 54 of the bag 48 can be fed through the retainer member 14 until the retainer member 14 is near the opening 52. The rim 50 of the bag 48 can then be folded over retainer member 14. With the bag 48 in place, the retainer member 14 is inserted into the groove 26 of the frame 12 to engage the engagement unit 32 of the retainer member 14 with the receiving unit 30 of the frame 12. Once assembled, the frame 12 and retainer 14 hold the rim 50 of the bag 48 as the objects to be collected (not shown) are introduced into the bag 48 through the orifice 18. FIG. 1 further shows that the frame 12 can include a handle 56 for holding the device 10 during use. As shown, the handle 56 can be molded together with the frame 12 at a location opposite the orifice 18 from the ramp 42. Alternatively, as shown in FIG. 5, a receptacle 58 for receiving an elongated pole 60 can be provided on the frame 12. For the embodiment shown in FIG. 5, a bracket 62 is mounted on the pole 60 to selectively hold an accessory. For example, as shown in FIG. 6A, the accessory can be a broom 64 having an elongated extension 66 and a substantially planar bristle brush 68. To match the frame 12 (see FIG. 3), the bristle brush 68 can be inclined to the extension 66 at an angle "θ", wherein the angle "θ" is in a range between ten and thirty degrees ($10° < \theta < 30°$). Alternatively, as shown in FIG. 6B, the accessory can be a scoop 70 having an elongated extension 72 and a shovel portion 74. To match the frame 12 (see FIG. 3), the shovel portion 74 can be inclined to the extension 72 at an angle "θ", wherein the angle "74 " is in a range between ten and thirty degrees ($10° < \theta < 30°$). In yet another alternative embodiment, the accessory may be a rake 76 (see FIG. 6C) having an elongated extension 78 and a substantially planar tine array 80. To match the frame 12 (See FIG. 3), the tine array 80 can be inclined to the extension 78 at an angle "θ", wherein the angle "θ" is in a range between ten and thirty degrees ($10° < \theta < 30°$).

While the particular portable trash bag support as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A device for collecting objects which comprises:

a bag having an opening surrounded by a rim portion;

a frame surrounding an orifice, wherein the frame is characterized by an irregular planar periphery, wherein the periphery defines a plane and is axisymmetric with respect to an axis in the plane of the periphery, and wherein the frame is formed with a peripheral groove;

a ramp formed on the frame, wherein the ramp extends along a portion of the periphery of the frame and is oriented substantially perpendicular to the axis, and wherein the ramp defines a straight edge with a flat surface extending between the straight edge and the periphery, and with the flat surface of the ramp inclined at an angle "ϕ" relative to the axis;

a retainer member dimensioned to be received into the peripheral groove of the frame for a fixed engagement of the retainer member onto the frame, to hold the rim of the bag between the frame and the retainer member for collecting objects into the bag through the orifice of the frame;

a receiving unit formed at the periphery of the frame adjacent the groove, wherein the receiving unit includes an access aperture straddled by a pair of holes, wherein the holes extend through the frame into the groove; and an engagement unit formed on the retainer member, wherein the engaging unit includes a press point straddled by a pair of retention tabs, wherein upon an engagement of the retainer member onto the frame the retention tabs are received into the holes of the receiving unit and the press point is positioned in the access aperture.

2. The device as recited in claim 1 wherein the incline angle "ϕ" of the ramp is in a range between three degrees and ten degrees ($3° < \phi < 10°$).

3. The device as recited in claim 1 wherein the frame and the ramp are made of a rigid plastic.

4. The device as recited in claim 1 further comprising a handle formed on the frame opposite the orifice from the ramp.

5. The device as recited in claim 4 wherein the handle is an elongated pole.

6. The device as recited in claim 5 further comprising a bracket, wherein the bracket is mounted on the pole to selectively hold an accessory thereon.

7. The device as recited in claim 6 wherein the accessory is a broom comprising:

an elongated extension; and a substantially planar bristle brush, wherein the bristle brush is inclined to the extension at an angle "θ", wherein the angle "θ" is in a range between ten and thirty degrees ($10° < \theta < 30°$).

8. The device as recited in claim 6 wherein the accessory is a scoop comprising:

an elongated extension; and a shovel portion, wherein the shovel portion is inclined to the extension at an angle "θ", wherein the angle "θ" is in a range between ten and thirty degrees ($10° < \theta < 30°$).

9. The device as recited in claim 6 wherein the accessory is a rake comprising:

an elongated extension; and a substantially planar tine array, wherein the tine array is inclined to the extension at an angle "θ", wherein the angle "θ" is in a range between ten and thirty degrees ($10° < \theta < 30°$).

* * * * *